US005369815A

United States Patent [19]

Martin

[11] Patent Number: 5,369,815

[45] Date of Patent: Dec. 6, 1994

[54] SINK STRAINER HAVING A DETACHABLE SEAL

[75] Inventor: Joseph R. Martin, Newport, Ky.

[73] Assignee: Jomar International, Ltd., Madison Heights, Mich.

[21] Appl. No.: 135,781

[22] Filed: Oct. 12, 1993

[51] Int. Cl.[5] ..... A47K 1/14

[52] U.S. Cl. ..... 4/287

[58] Field of Search ..... 4/286-292

[56] References Cited

U.S. PATENT DOCUMENTS

| | | | |
|---|---|---|---|
| 2,668,962 | 2/1954 | Spector | 4/287 |
| 2,890,463 | 6/1959 | Young | 4/287 |
| 3,800,339 | 4/1974 | Bergin | 4/287 |
| 3,802,001 | 4/1974 | Richards | 4/287 |
| 4,586,203 | 5/1986 | Westgerdes | 4/287 |

FOREIGN PATENT DOCUMENTS

| | | | |
|---|---|---|---|
| 0064712 | 10/1949 | Netherlands | 4/287 |
| 0627911 | 8/1949 | United Kingdom | 4/287 |

*Primary Examiner*—Charles E. Phillips

*Attorney, Agent, or Firm*—Robert G. Mentag

[57] ABSTRACT

A sink strainer having a hollow strainer body with an open upper end with an outlet member at the lower end thereof on which is formed an annular valve seat. A basket strainer is operatively mounted in the strainer body and it is movable between an open and closed position. The basket strainer includes a valve stem which is movable relative to the basket strainer and which carries a valve provided with a detachable peripheral elastomeric seal for seating engagement on the valve seat on the outlet member.

3 Claims, 3 Drawing Sheets

SINK STRAINER HAVING A DETACHABLE SEAL

BACKGROUND OF THE INVENTION

1. Field of the Invention

The field of art to which this invention pertains may be generally located in the class of devices relating to sink strainers. Class 4, Subclass 286, Sink Strainers and Stoppers United States Patent Office Classification, appears to be the applicable general area of art to which the subject matter similar to this invention has been classified in the past.

2. Description of the Prior Art

This invention relates to sink strainers, and more particularly to the type of sink strainer used with kitchen sinks or the like. Sink strainers of the type to which this invention is directed generally include a substantially large body in which is seated a basket strainer having a rubber stopper. The basket strainers are adapted to be moved manually between opened and closed positions to permit draining and filling of the sink. Heretofore, basket strainers of this type have relied on the weight of the water in the sink to push the basket strainer's rubber stopper against the strainer body to prevent leakage of water from the sink when it is desired to retain water in the sink. However, it has been found that the weight of water in the sink does not create enough downward force to provide a leakproof seal, and accordingly, there is always some leakage by such prior art basket strainers. Heretofore, attempts have been made to provide a strainer basket or crumb cup which has a valve disc that is adapted to seat and close the drain opening in the strainer upon rotational movement of a valve stem in one direction, and conversely to open the drain upon a rotational movement of the valve stem in the opposite direction. The last mentioned type of sink strainer structure is shown in the prior art U.S. Pat. No. 2,890,463. A disadvantage of the prior art sink strainer is that it is expensive to make because the valve disc must be machined to seat on a machined surface in the sink strainer to provide a metal to metal seating seal which will not leak. A further disadvantage is that most sink strainers are made with a stamped body and the metal valve disc employed in the last mentioned patent is not capable of providing a leakproof metal to metal seating seal with such a stamped sink strainer body.

SUMMARY OF THE INVENTION

In accordance with the present invention, a sink strainer for a kitchen or the like, is provided which has a hollow strainer body with an open cylindrical upper end and a tubular outlet at a lower end. The tubular outlet has a dish-shaped outlet member operatively mounted in the upper end thereof and it has an annular valve seat formed thereon. A basket strainer is operatively mounted within the sink strainer hollow body and it is provided with suitable drain openings for drainage of liquid disposed within the sink strainer hollow body. The basket strainer has a bottom wall with a vertical, centrally disposed elongated valve stem guide bushing fixedly mounted on the upper side thereof. A valve stem, having an upper end and a lower end, is slidably mounted through the guide bushing for up and down movement relative to the basket strainer. An annular valve member is releasably secured to the valve stem below the basket strainer. A handle is secured to the upper end of the valve stem for rotating the valve stem in opposite directions. The valve stem has a screw threaded peripheral portion on the its lower end, below the annular valve member. A dish-shaped outlet member has a screw threaded bushing disposed centrally thereof, in which the screw threaded peripheral portion on the valve stem is threadably received. The annular valve member is provided with an annular elastomeric seal which is detachably mounted around the periphery thereof, whereby when the stem valve is turned by the handle in one direction, the annular valve member and its annular seal will be raised off of the annular valve seat, and when the valve stem is turned by the handle in an opposite direction the valve member and its annular seal will move downwardly against the annular valve seat.

The annular valve member includes a round plate valve body which has an integral peripheral flange that angles upwardly and transversely outward to form on the lower side thereof, an annular sloping valve face for seating engagement on the annular seat formed on the dish-shaped outlet member. The annular elastomeric seal is detachably mounted on the integral peripheral flange and covers the annular sloping valve face. The elastomeric annular detachable seal comprises an upper peripheral wall and a lower peripheral wall, and said seal walls are connected at the outer peripheral ends thereof by a bight wall.

The detachable seal permits the use of a sink strainer body made by a stamping operation instead of a precise machining operation. The rubber seal takes up or overcomes any errors in the surface of the annular valve seat incurred because of the stamping operation which is much cheaper than forming the valve seat by a machine operation. Furthermore the detachable elastomeric annular seal may be replaced when required if it wears out, and accordingly, it provides an economical sink strainer construction because the entire basket strainer does not have to be replaced, which would be required if the basket strainer had a molded elastomeric seal on the bottom thereof to seat against a valve seat in the sink strainer body.

DESCRIPTION OF THE PREFERRED EMBODIMENT

Figure 2:
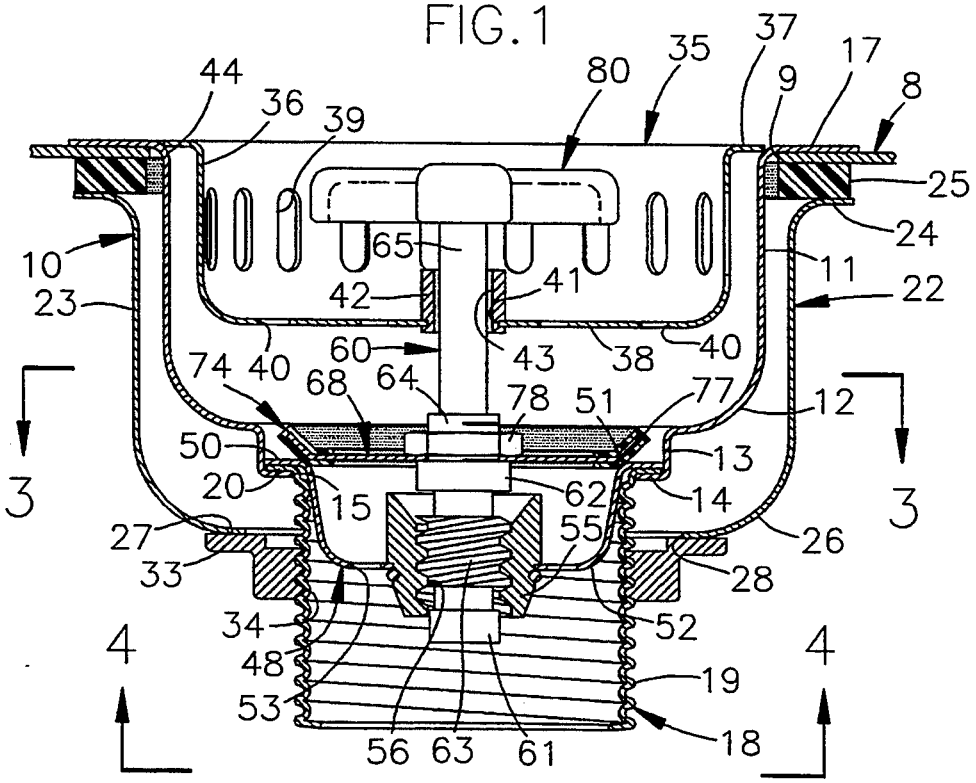
FIG. 2 is an elevation section view of the sink strainer illustrated in FIG. 1, taken along the line 2—2 thereof, and looking in the direction of the arrows.

Referring now to FIG. 2, a sink fragment is generally indicated by the numeral 8, which is provided with the usual relatively large diameter opening 9 therethrough, in which a sink strainer, generally indicated by the numeral 10, and made in accordance with the principles of the present invention is mounted. The sink strainer 10 comprises a hollow, substantially cylindrical body member which has an open cylindrical upper end portion 11 and an integral concave lower end body portion 12. The concave lower end body portion 12 is integral at its lower end with a short vertical lower end wall 13 which is cylindrical and disposed parallel to the cylindrical upper end wall 11. The lower end of the wall 13 is integral with a transverse, inwardly extended, annular flange 14, through which is formed an axial outlet opening indicated by the numeral 15.

Figure 5:
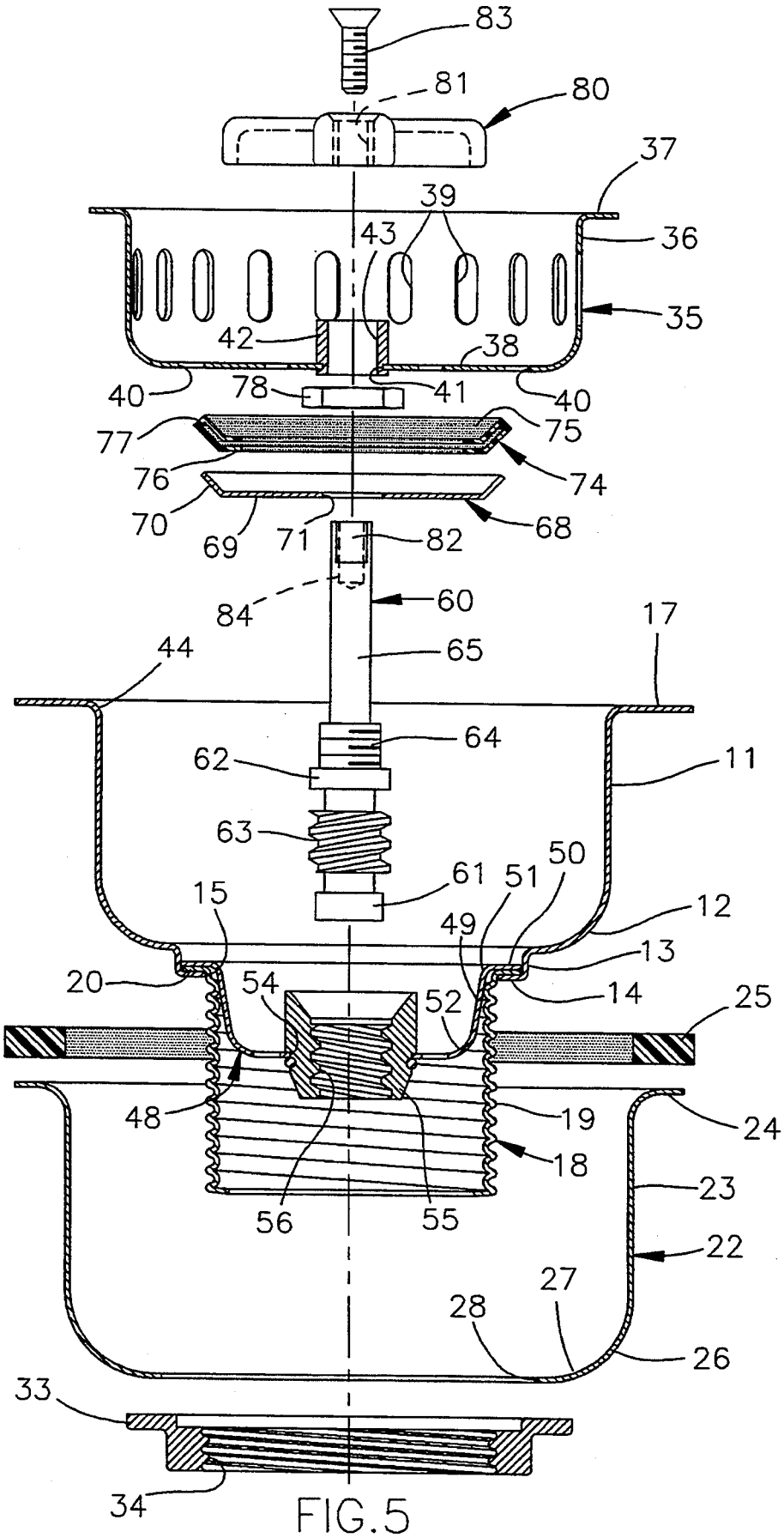
FIG. 5 is an exploded view of the parts of the sink strainer illustrated in FIGS. 1–4, and showing the association of the parts relative to each other.

As shown in FIGS. 2 and 5, the sink strainer body has a tubular outlet member, generally indicated by the numeral 18. The lower end portion 19 of the tubular outlet member 18 is provided with a threaded periphery. An outwardly extended, transverse peripheral flange 20 is integrally formed on the upper end of the tubular outlet member lower end portion 19. The tubular outlet member lower end portion 19 is seated through the cylindrical opening 15 in the sink strainer body portion transverse annular flange 14, with the flange 20 on the tubular outlet member 18 seated on the upper side of the sink strainer body flange 14. An annular flange 17 is integrally formed around the upper edge of the sink strainer body upper end portion 11.

As shown in FIG. 2, the sink strainer body is held in the opening 9 in the sink 8 by a conventional cup-shaped clamp, generally indicated by the numeral 22. The cup-shaped clamp 22 has an upper cylindrical body portion 23 which has an integral, transverse peripheral flange 24 formed on the upper edge thereof. The flange 24 engages the lower side of an annular gasket 25 for clamping the sink strainer 10 in place on the sink 8. The cup-shaped clamp 22 further includes a lower body concave portion 26 which is integral with the upper body portion 23 and which converges downwardly at its lower end to form a flat bottom portion 27 that has a central opening 28 formed therethrough. The cup-shaped clamp 22 is held in an operative position against the lower side of the gasket by a suitable lock nut 33 which is provided with an axial threaded bore 34.

The lock nut 33 is threadably mounted on the threaded lower end portion 19 of the tubular outlet member 18. It will be seen, that when the lock nut 33 is threaded upwardly, it creates a pressure on the flat bottom portion 27 of the cup-shaped clamp to force the clamp flange 24 upwardly into a compression engagement with the lower side of the gasket 25 while simultaneously creating a downward clamping force of the flange 17 on the top of the sink 8.

As shown in FIG. 2, a basket strainer or crumb cup, generally indicated by the numeral 35, is supported within the sink strainer cylindrical body. The basket strainer 35 includes a cylindrical sidewall 36 which has integrally formed on the upper end thereof a transverse, outwardly extended peripheral flange 37. The basket strainer 35 is supported in the sink strainer cylindrical body by means of the peripheral flange 37 being supported upon the circular shoulder 44 formed at the juncture of the sink strainer body sidewall 11 and the integral upper flange 17. The basket strainer 35 is provided with the usual plurality of openings 39 in the basket strainer sidewall 36. The basket strainer 35 includes a transverse bottom wall 38 which is provided with a plurality of usual drain openings 40. The basket strainer bottom wall 38 has a circular axial opening 41 formed therethrough in which is mounted, by any suitable means a guide bushing 42 having an axial guide bore 43. As illustrated in FIGS. 2 and 5, the guide bushing 42 has an external peripheral groove (no number) formed around the lower end thereof, and the guide bushing 42 may be moved downwardly into the bottom wall opening 41 and snapped in place, with the peripheral edge of the opening 41 in the basket strainer bottom wall 38 being snapped into position in the last mentioned peripheral groove (no number). The drain holes 39 and 40 permit the water to drain through the basket strainer 35 in the usual manner but retain particles of food and the like, and prevent those particles from passing through the sink strainer and into the waste line, in the usual manner.

Figure 4:
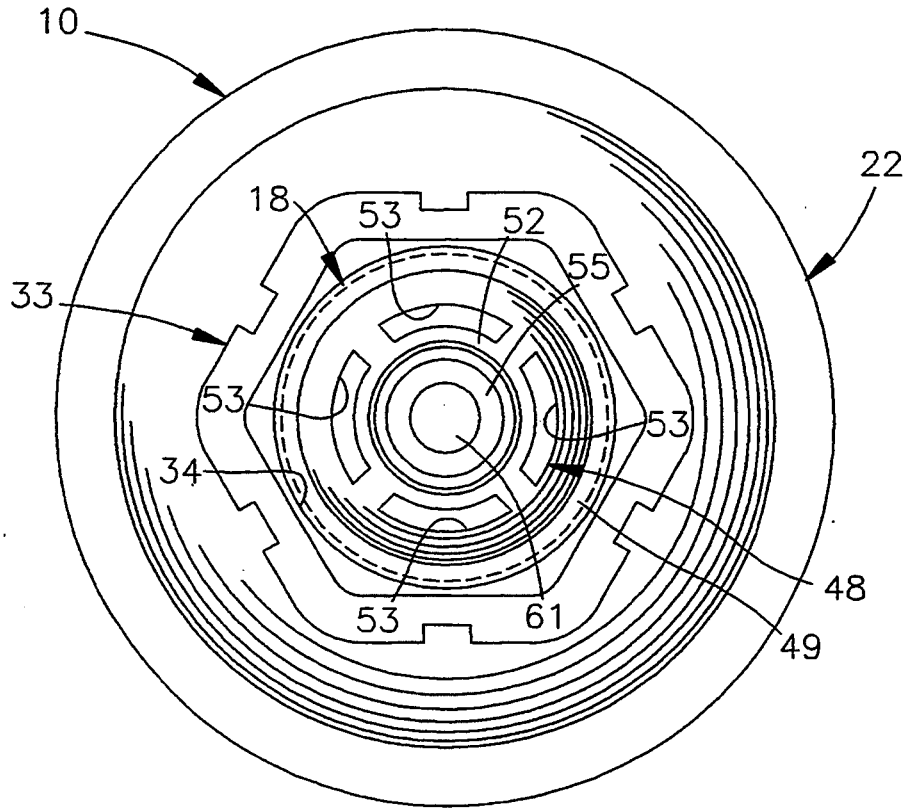
FIG. 4 is a bottom end view of the sink strainer structure illustrated in FIG. 2, taken along the line 4—4 thereof, and looking in the direction of the arrows.

As shown in FIGS. 2 and 5, a dish-shaped outlet member, generally designated by the numeral 48, is operatively mounted in the upper end of the tubular outlet 18. As best seen in FIG. 5, the dish-shaped outlet member 48 includes a tubular sidewall 49 which angles upwardly from an integral transverse bottom wall 52 and terminates at its upper end with a transverse, outwardly extended integral flange 50. The flange 50 seats on the upper surface of the tubular outlet flange 20, and they are fixedly secured together with the transverse annular flange 14 of the sink strainer body, by any suitable means, as by welding. An annular valve seat 51 is formed by the curved juncture point between the upper end of the dish-shaped outlet member sidewall 49 and its outwardly extended integral flange 50. As best seen in FIG. 4, a plurality of arc shaped drain openings 53 are formed through the bottom wall 52 of the dish-shaped outlet member 48. A central opening 54 (FIG. 5) is formed through the dish-shaped outlet member bottom wall 52, and operatively mounted therein and fixedly secured thereto, by any suitable means, as by welding, is a threaded bushing 55 which has an axial threaded bore 56.

Figure 3:
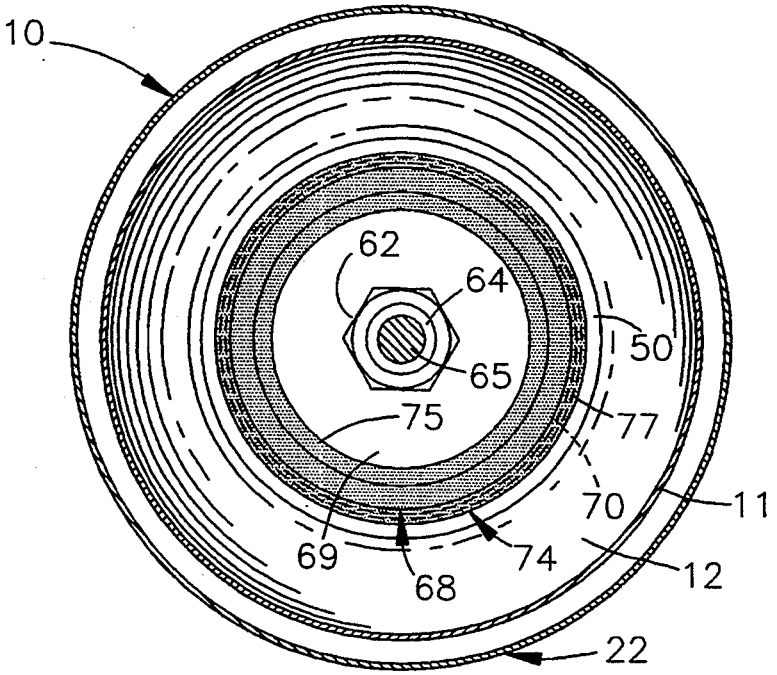
FIG. 3 is a horizontal, section view, of the sink strainer structure illustrated in FIG. 2, taken along the line 3—3 thereof, and looking in the direction of the arrows.

As best seen in FIG. 5, the numeral 60 generally designates a valve stem having a pair of annular, longitudinally spaced apart, peripheral flanges 61 and 62 formed on the lower end thereof. The outer periphery of the valve stem 60, between the annular peripheral flanges 61 and 62, is provided with a suitable fast operating thread 63, such as a double or triple Acme thread. The periphery of the stem 60 immediately above the upper peripheral flange 62 is threaded, as indicated by the numeral 64. The upper end 65 of valve stem 60 is made to a reduced diameter, and this portion may be termed an upper guide stem portion. As shown in FIG. 2, an annular valve member, generally indicated by the numeral 68, is releasably mounted on the valve stem upper guide section 65 in a position seated against the upper peripheral flange 62. The annular valve member 68 is held in a locked position against the peripheral flange 62 by a suitable lock nut 78. As illustrated in FIG. 3, the annular valve member 68 includes a valve body in the form of a round plate 69. As illustrated in FIGS. 2 and 5, the valve body 69 has formed around the periphery thereof an integral flange 70 which angles upwardly and transversely outward to form an annular sloping valve face. As shown in FIG. 5, the annular valve member 68 is provided with an axial hole 71, formed through the round plate valve body 69, and through which is received the upper guide section portion 65 of the valve stem 60, for mounting the annular valve member round plate valve body 69 on the stem 60 against the upper face of the upper peripheral flange 62. As shown in FIG. 3, the annular valve member 68 has detachably mounted around the periphery thereof, a valve seal, generally indicated by the numeral 74. As illustrated in FIG. 5, the detachable valve seal 74 includes an upper peripheral wall 75 and a lower peripheral wall 76. The upper outer ends of the seal walls 75 and 76 are integrally connected by a connecting transverse or bight wall 77 so as to provide an annular seal which is substantially U-shaped in cross section. The annular valve seal 74 is adapted to be slidably mounted on the periphery of the valve body flange 70 from the upper end thereof. As shown in FIG. 2, the upper guide section 65 of the valve stem 60 extends upwardly through the central opening 71 in the valve body round plate 69 and through the bore 43 in the guide bushing 42. A handle, generally indicated by the numeral 80, has an axial bore 81 (FIG. 5) formed therethrough for the reception of the upper end of the valve stem upper guide section 65. The bore 81 in the handle 80 is provided with a flat portion for the sliding reception of a flat face 82, on the upper end of the valve stem upper guide section 65, which prevents rotation of the handle 80 on the valve stem 60. The handle 80 is releasably attached to the valve stem 60 by a suitable screw 83 which is threadably mounted into a threaded hole 84 formed in the upper end of the valve stem 60.

The threads in the threaded bore 56 in the bushing 55 are also a suitable fast operating thread, such as a double or triple Acme thread.

Figure 1:
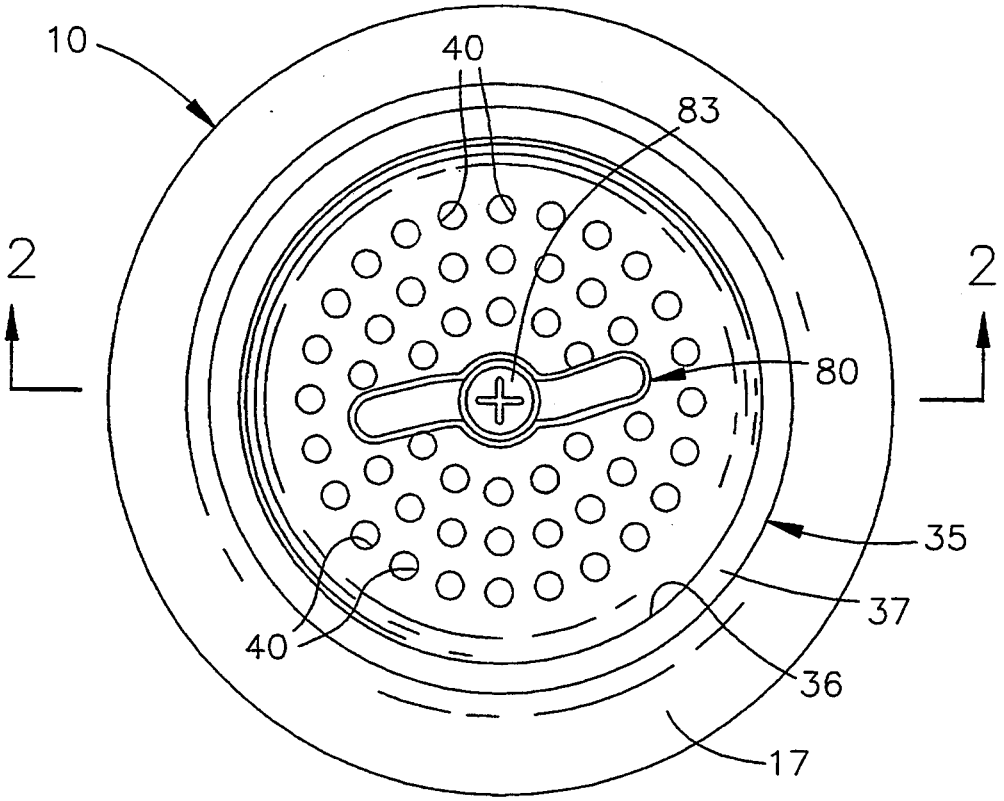
FIG. 1 is a top plan view a sink strainer made in accordance with the principles of the present invention.

It will be seen that the assembly of the basket strainer 35 and the valve stem 60, with the annular valve 68 mounted thereon, and with the handle 80 attached to the valve stem 60 forms a structure which is completely removable from the sink strainer body when the handle 80 is rotated in a counterclockwise direction, as viewed in FIG. 1. The last mentioned assembly of the basket strainer 35 and the annular valve 68 may be quickly and easily mounted in place in the sink strainer body by moving the valve stem 60 downwardly to engage the thread 63 thereon with the thread 56 in the threaded bushing 55 and rotating the handle 80 in a clockwise direction. If the handle 80 is rotated in the clockwise direction to a point where the detachable valve seal 74 is in a seating and sealing engagement with the annular valve seat 51, the flow of fluid through the tubular outlet 18 is closed off, to thereby maintain the sink 8 in its filled position, when desired. It will also be seen that when the handle 80 is rotated in the counterclockwise direction, as viewed in FIG. 1, the valve member 68 and the detachable seal 74 will be raised from its seated position on the valve seat 51, as shown in FIG. 2, to a position spaced upwardly apart from the annular valve seat 51, to permit a flow of fluid from the sink 8 and down and out through the tubular outlet 18.

It will be understood that the detachable valve seal 74 may be quickly and easily replaced if it wears out or becomes damaged at a minimum repair cost. It is cheaper to replace the valve seal 74, then to replace an entire basket strainer to which a seal is molded, as in the prior art basket strainers employing molded seals and which depend upon the weight of the water in a sink to press the seal into sealing engagement with a valve seat in a sink strainer. The provision of the detachable annular seal 74 on the valve member 68 provides an efficient valve and seal combination which can be used in a sink strainer body which is stamped and not machined. A stamped sink strainer body has uneven surfaces, but such surfaces do not prevent the detachable seal 74 on the annular valve 68 from providing an efficient sealing action between the valve 68 and an annular valve seat 51 in a stamped sink strainer body. It will be understood that the detachable valve seal 74 be made from any suitable elastomeric material. The detachable seal 74 permits the annular valve 68 to be made from a stamping. In one embodiment the upper and lower walls 75 and 76 of the seal 74 were of size to extend downwardly over the valve flange about ¼ of an inch to a position where the inner edges thereof were positioned over the entire flange 70 and extended inwardly onto a peripheral portion of the round plate valve body 69. It will be seen from the aforegoing that the basket strainer 35 and the annular valve member 68 may be removed as a unit from the sink strainer body when it is desired to clean the basket strainer 35 and any crumbs or other matter that may be caught in the basket strainer 35.

What is claimed is:

1. A sink strainer (10) comprising:

(a) a hollow body having an open cylindrical upper end (11) and a tubular outlet at a lower end (18);

(b) said tubular outlet (18) having a dish-shaped outlet member (48) operatively mounted in the upper end thereof and which has an annular valve seat (51) formed thereon;

(c) a basket strainer (35) operatively mounted within said hollow body and provided with drain openings (38,40) for drainage of liquid disposed within the hollow body;

(d) said basket strainer (35) having a bottom wall (38) with a vertical, centrally disposed elongated valve stem guide bushing (42) fixedly mounted on the upper side thereof;

(e) a valve stem (60), having an upper guide stem portion (65) that is slidably mounted through the guide bushing (42) for up and down movement relative to the basket strainer (35), the valve stem (60) being provided at the lower end of the guide stem portion (65) with an enlarged diameter integral threaded portion (64), and a peripheral flange (62) is integrally formed on the valve stem (60) below the threaded portion (64);

(f) an annular valve member (68) provided with an axial hole (71) is mounted on the valve stem (60), with the guide stem portion (65) slidably mounted through said axial hole (71), and the annular valve member (68) being seated against said peripheral flange (62) and releasably secured to the valve stem (60), below the basket strainer (35), by a lock nut (78) threadably mounted on said guide stem threaded portion (64);

(g) a handle (80) secured to the upper end of the valve stem (60) for rotating the valve stem (60) in opposite directions;

(h) said valve stem (60) having a screw threaded peripheral portion (63) formed on its lower end, below said peripheral flange (62) and the annular valve member (68);

(i) a dish-shaped outlet member (48) having a screw threaded bushing (55) disposed centrally thereof in which the screw threaded peripheral portion (63) on the valve stem (60) is threadably received; and, (j) said annular valve member (68) being provided with an annular elastomeric seal (74) detachably mounted around the periphery thereof, whereby when the valve stem (60) is turned by said handle (80) in one direction the annular valve member (68) and its annular seal (74) will be raised off of said annular valve seat (51), and when the valve stem (60) is turned by said handle (80) in an opposite direction the valve member (68) and its annular seal

(74) will move downwardly against said annular valve seat (51).

2. A sink strainer as defined in claim 1, wherein:

(a) said annular valve member (68) includes a round plate valve body (69) provided with an integral peripheral flange (70) and which angles upwardly and transversely outward to form on the lower side thereof an annular sloping valve face for seating engagement on said annular valve seat (51); and, (b) said annular elastomeric seal (74) is detachably mounted on the integral peripheral flange (70) which covers said annular sloping valve face.

3. A sink strainer as defined in claim 2, wherein:

(a) said elastomeric annular detachable seal (74) comprises an upper peripheral wall (75) and a lower peripheral wall (76), and said seal walls (75,76) are connected at the outer peripheral ends thereof by a bight wall (77).

* * * * *